United States Patent [19]

Crawford et al.

[11] Patent Number: 5,059,247

[45] Date of Patent: Oct. 22, 1991

[54] METHOD FOR THE PREPARATION OF FOUNDRY SAND COMPOSITIONS

[75] Inventors: Wheeler C. Crawford, Houston; Michael Cuscurida, Austin, both of Tex.

[73] Assignee: Texaco Chemical Company, White Plains, N.Y.

[21] Appl. No.: 569,896

[22] Filed: Aug. 20, 1990

[51] Int. Cl.[5] ..... B28B 7/34

[52] U.S. Cl. ..... 106/38.35; 106/634

[58] Field of Search ..... 106/38.35, 634

[56] References Cited

U.S. PATENT DOCUMENTS

| | | | |
|---|---|---|---|
| 4,267,120 | 5/1981 | Cuscurida et al. | 260/463 |
| 4,359,507 | 11/1982 | Gaul et al. | 428/425.1 |
| 4,416,694 | 11/1983 | Stevenson et al. | 106/84 |
| 4,488,982 | 12/1984 | Cuscurida et al. | 252/174.21 |
| 4,773,466 | 9/1988 | Cannarsa et al. | 164/45 |

OTHER PUBLICATIONS

*Encyclopedia of Science & Technology,* McGraw-Hill, 5th Ed., pp. 392-396.

"Foundry Practice", Foseco International, Ltd., No. 213, Aug. 1986.

*Primary Examiner*—Mark L. Bell

*Assistant Examiner*—Deborah Jones

*Attorney, Agent, or Firm*—Jack H. Park; Kenneth R. Priem; Carl G. Ries

[57] ABSTRACT

A foundry sand composition that is self-hardening after a working life of about 10-20 minutes that is composed of a foundry sand, a sodium silicate binder and a specifically defined polyester polycarbonate hardener is prepared by:

a) mixing a foundry sand with about 2-6 wt. %, based on the foundry sand, of an aqueous solution containing about 40-60 wt. % of sodium silicate, the ratio of $SiO_2/Na_2O$ of the sodium silicate about 2.2 to 3, to form an initial sand mixture, and b) then adding about 5-15 wt. % of the polyester polycarbonate hardener, based on the weight of the aqueous solution of sodium silicate, to provide the foundry sand composition.

18 Claims, No Drawings

METHOD FOR THE PREPARATION OF FOUNDRY SAND COMPOSITIONS

BACKGROUND OF THE INVENTION

1. Technical Field of the Invention

This invention relates to foundry sand compositions of the type used to form self-hardening sand cores and molds for use in metal casting. The foundry sand compositions are prepared from a foundry sand, an aqueous solution of sodium silicate and a polyester polycarbonate as hereinafter defined.

In accordance with a preferred embodiment of the present invention, a foundry sand is mixed with about 2 to about 6 wt. %, based on the foundry sand, of an aqueous solution containing from about 40 to about 60 wt. % of sodium silicate, the ratio of the $SiO_2/Na_2O$ of the sodium silicate being within the range of about 2.2 to 3 to form an initial sand mixture to which a polyester polycarbonate hardener is added in an amount of about 5 to about 15 wt. %, based on the weight of the aqueous solution of sodium silicate. The thus-prepared foundry sand compositions will normally have a working life of about 10 to about 20 minutes and will thereafter gel and harden. While the foundry sand composition is still pliable and before it has gelled, it is shaped, for example, in a core box into which a model of a core is placed to form a design so that, after the foundry sand composition gels and hardens, the hardened, formed mold may be used to cast a metal core.

2. Prior Art

The use of mixtures of sand with a binder to prepare molds for metal casting is well-known. See, for example, the McGraw-Hill "Encyclopedia of Science and Technology", 5th Edition, Vol. 8, pp. 392–396 (McGraw-Hill Book Company, New York, St. Louis & San Francisco).

Stevenson et al. U.S. Pat. No. 4,416,694 discloses foundry sand compositions made from a foundry sand, an aqueous sodium silicate binder and an alkylene carbonate which are used to form molds and/or cores in metal casting. The foundry sand in the foundry sand compositions disclosed by Stevenson et al. is reclaimed after the mold or core has served its purpose in metal casting.

Cuscurida et al. U.S. Pat. No. 4,267,120 is directed to polyester polycarbonates of the type used in the practice of the present invention and to methods by which they can be prepared. Cuscurida et al. teach that the polyester polycarbonates can be used in making polymer foams including polyurethane polymers and polyisocyanurate polymers.

Gaul et al. U.S. Pat. No. 4,359,507 is directed to an adhesive binder composition for the preparation of lignocellulosic composite molded articles made from organic polyisocyanates and a liquid mixture of either ethylene carbonate or propylene carbonate with lignin and other appropriate lignocellulosic materials.

Cannarsa et al. U.S. Pat. No. 4,773,466 is directed to the evaporative casting of molten metals using copolymer polycarbonates prepared from cyclohexene oxide, cyclopentene oxide, heptene oxide or isobutylene oxide and carbon monoxide.

Cuscurida et al. U.S. Pat. No. 4,488,982 is directed to improved surfactants in functional fluids prepared by reacting a monofunctional initiator with an alkylene carbonate or with an alkylene oxide and carbon dioxide to form a polyether polycarbonate material.

A trade brochure entitled "Foundry Practice 213", dated August, 1986, and published by Foseco International, Ltd., Birmingham, England, describes a method for preparing molds from sand and a binder composition and for reclaiming the foundry sand used in making the mold. Binders, such as mixtures of an aqueous solution of sodium silicate with an alkylene carbonate, as disclosed in Stevenson et al. U.S. Pat. No. 4,416,694 may be mixed with the foundry sand and used in preparing the molds.

SUMMARY OF THE INVENTION

In accordance with the present invention, a foundry sand composition having a work life of about 10 to about 20 minutes which is self-hardening is prepared by first mixing an aqueous solution of a sodium silicate with a foundry sand and by thereafter mixing a polyester polycarbonate hardener with the foundry sand to form the desired foundry sand composition, the polyester polycarbonate hardening agent being a polyester polycarbonate having the formula:

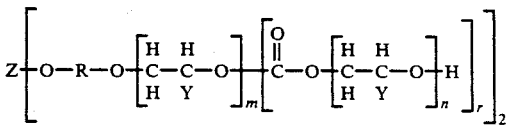

wherein Y is H or methyl, wherein m and n are positive numbers having a value of 1 to about 5, wherein R is a polyoxyethylene or a polyoxypropylene group having an average molecular weight between about 62 and 600, wherein r is a positive integer having a value of 1 to 5, wherein Z is a difunctional group formed by the reaction of an acid anhydride with a polyoxyethylene glycol or a polyoxypropylene glycol, and wherein the acid anhydride is an anhydride of an organic acid selected from the group consisting of maleic anhydride, succinic anhydride and phthalic anhydride.

DESCRIPTION OF THE PREFERRED EMBODIMENT

In accordance with the present invention, a foundry sand composition that is self-hardening after a working life of about 10 to about 20 minutes is prepared by the steps of:

a) mixing a foundry sand with about 2 to about 6 wt. %, based on the foundry sand, of an aqueous solution containing about 40 to about 60 wt. % of a sodium silicate wherein the ratio of $SiO_2/Na_2O$ is within the range of about 2.2 to 3 to form an initial sand mixture, and b) adding to the initial sand mixture from about 5 to about 15 wt. %, based on the weight of the aqueous solution of the sodium silicate, of a polyester polycarbonate hardener to thereby provide the foundry sand composition of the present invention, the polyester polycarbonate hardener having the formula:

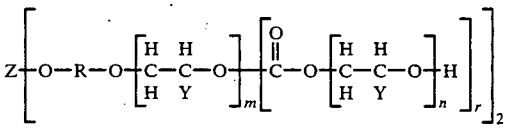

wherein Y is H or methyl, wherein m and n are positive numbers having a value of 1 to about 5, wherein R is a polyoxyethylene or a polyoxypropylene group having an average molecular weight between about 62 and 600, wherein r is a positive integer having a value of 1 to 5, wherein Z is a difunctional group formed by the reaction of an acid anhydride with a polyoxyethylene glycol or a polyoxypropylene glycol, and wherein the acid anhydride is an anhydride of an organic acid selected from the group consisting of maleic anhydride, succinic anhydride and phthalic anhydride.

The starting materials for the present invention are a foundry sand, an aqueous solution of sodium silicate and a polyester polycarbonate.

Foundry sands and aqueous solutions of sodium silicate are stable articles of commerce that are widely used in the preparation of molds and/or cores for use in metal casting.

It is an important aspect of the present invention to use an aqueous solution of a sodium silicate wherein the ratio of $SiO_2/Na_2O$ is within the range of about 2.2 to about 3.

The polyester polycarbonates to be used in the practice of the present invention are polyester polycarbonates of the type disclosed in Cuscurida et al. U.S. Pat. No. 4,267,120 and, more particularly, are polyester polycarbonates having the formula:

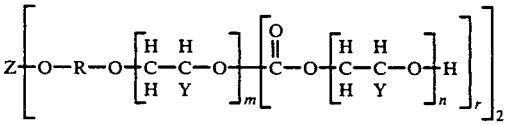

wherein Y is H or methyl, wherein m and n are positive numbers having a value of 1 to about 5, wherein R is a polyoxyethylene or a polyoxypropylene group having an average molecular weight between about 62 and 600, wherein r is a positive integer having a value of 1 to 5, wherein Z is a difunctional group formed by the reaction of an acid anhydride with a polyoxyethylene glycol or a polyoxypropylene glycol, and wherein the acid anhydride is an anhydride of an organic acid selected from the group consisting of maleic anhydride, succinic anhydride and phthalic anhydride.

The polyester polycarbonates are made from an organic acid anhydride, namely, maleic anhydride, succinic anhydride or phthalic anhydride, polyoxyethylene or polyoxypropylene glycols, carbon dioxide, ethylene oxide, propylene oxide or ethylene carbonate or propylene carbonate.

The polyester polycarbonates can be prepared by any one of the several methods disclosed in U.S. Pat. No. 4,267,120.

Thus, the polyester polycarbonates can be obtained by the reaction of the acid anhydride with ethylene oxide or propylene oxide, carbon dioxide and a polyoxyethylene or polyoxypropylene glycol in the presence of a basic catalyst. The resultant polyester polycarbonates are terminated with hydroxyl groups, have molecular weights within the range of about 220 to about 2,000 and have hydroxyl numbers within the range of about 50 to about 400.

In accordance with one method of preparation, the organic acid anhydride, the polyoxyethylene or polyoxypropylene glycol, the ethylene oxide or propylene oxide and carbon dioxide or ethylene carbonate and propylene carbonate are simultaneously brought into contact with a basic catalyst at an elevated temperature.

In accordance with another method, the acid anhydride, the polyoxyethylene or polyoxypropylene glycol and ethylene carbonate or propylene carbonate are simultaneously brought into contact with a basic catalyst at an elevated temperature. In this situation, the cyclic carbonate will, in the reaction environment, form the corresponding epoxide and carbon dioxide.

In yet another embodiment, the acid anhydride is initially reacted with the polyoxyethylene or polyoxypropylene glycol to form a mixture comprising the half ester and/or the diester of the acid anhydride. The resultant reaction mixture is then brought into contact with ethylene oxide or proylene oxide and with carbon dioxide or ethylene carbonate or propylene carbonate to provide the desired polyester polycarbonate product.

As indicated earlier, the organic acid anhydrides to be used as starting materials in accordance with the present invention are maleic anhydride, succinic anhydride and phthalic anhydride.

The polyoxyethylene and polyoxypropylene glycols to be used in accordance with the present invention are glycols having a molecular weight of about 62 to about 600.

Carbon dioxide is provided in the form of solid or gaseous carbon dioxide or by using ethylene carbonate or propylene carbonate, which are cyclic materials, which can be used to form ethylene oxide or propylene oxide and carbon dioxide in situ.

The cyclic ethylene and propylene carbonates have the formula:

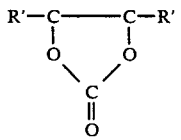

wherein R′ represents hydrogen or methyl.

In preparing the polyester polycarbonates, the polyoxyethylene or polyoxypropylene glycol and the organic acid anhydride are employed in the mole ratio of from about 1:1 to about 10:1. The ethylene oxide and propylene oxide and the carbon dioxide, as such, or as ethylene or propylene carbonate, is employed in the mole ratio of about 2:1 to about 4:1.

The basic catalyst that can be used to promote the formation of the polyester polycarbonates include alkali metal and alkaline earth metal carbonates such as sodium carbonate, potassium carbonate, magnesium carbonate, potassium stannate, sodium stannate and the like. The polyester polycarbonate reactions are normally conducted at a temperature within the range of about 100° to about 200° C.

SPECIFIC EXAMPLES

The invention will be further illustrated by the following specific examples which are given by way of illustration and not as limitations on the scope of this invention. Unless otherwise designated, where parts are given they are parts by weight.

EXAMPLE 1

This example will show the use of a polyester polycarbonate, prepared as described in Example 1 of U.S. Pat. No. 4,267,120 in the gelation of aqueous sodium silicate solutions. It was prepared by the reaction of 0.405 lb. ethylene glycol, 0.97 lb. phthalic anhydride, 8.62 lb. ethylene carbonate and 9.1 g potassium stannate catalyst. The polyester polycarbonate had the following properties:

| Properties | Sample No. 4725-75 |
|---|---|
| Hydroxyl no., mg KOH/g | 224 |
| Saponification no., mg KOH/g | 236 |
| Carbon dioxide content, wt. % | 23.6 |
| Viscosity, 77° F., cps | 1984 |

It will further show the use of cyclic alkylene carbonates such as ethylene carbonate (EC) and propylene carbonate (PC) in this reaction.

9 Grams of an aqueous sodium silicate solution (40°–42° Be, $SiO_2/Na_2O$ 2.5) and 1 g of the hardening agent were charged into a small plastic container. The sodium silicate and hardener were then vigorously mixed using a wooden or metal spatula. The gel time was defined as the point at which the mixture ceased to flow when the spatula was withdrawn from the mixture.

Results are shown in the following table.

| Sample No. | 6367-48E | 6367-48B | 6367-47A | 6367-48C |
|---|---|---|---|---|
| Carbonate used | Polyester Polycarbonate | EC | PC | BC |
| Gel time, sec. | 10–11 min. | 10–15 sec. | 45–60 sec. | 20 min. |

EXAMPLE 2

This example will show that the polyester polycarbonate of Example 1 can be mixed with propylene carbonate (PC) to modify the reactivity of the system. Using the procedure of Example 1, 9 g of the sodium silicate solution, 0.5 g PC, and 0.5 g polyester polycarbonate were thoroughly mixed with a spatula. The mixture gelled in 2.5–3.0 minutes.

EXAMPLE 3

This example will illustrate that sodium silicate solutions which have an $SiO_2/Na_2O$ ratio of 2.0* will not gel regardless of the carbonate used. This indicates that the $SiO_2/Na_2O$ ratio of the sodium silicate solutions should be approximately 2.2–3.0 before any of these hardening agents or promoters will work.

| Sample No. | 6367-57A | 6367-57B | 6367-57C | 6367-57D |
|---|---|---|---|---|
| Carbonate used | EC | PC | BC | Polyester Polycarbonate |
| Gel time, min. | No gel | No gel | No gel | No gel |

*Power silicates ($SiO_2/Na_2O$ 2.0)

EXAMPLE 4

Mix about 100 parts by weight of a foundry sand with about 4 parts by weight of a binder composition of Example 1. The resultant foundry sand composition will have a working life of about 10 to 20 minutes and can be used in preparing a foundry mold or a foundry core mold by any suitable method, such as the method disclosed in "Foundry Practice 213".

Having thus described our invention, what is claimed is:

1. In a method for the preparation of a foundry sand composition wherein a foundry sand is first mixed with a sodium silicate binder having a ratio $SiO_2/Na_2O$ within the range of about 2.2 to 3 and then with a carbonate hardener to provide a foundry sand composition and wherein the foundry sand composition is then molded to form a self-hardening sand core for use in metal casting, the improvement which comprises using, as the carbonate hardner, a carbonate compound having the formula:

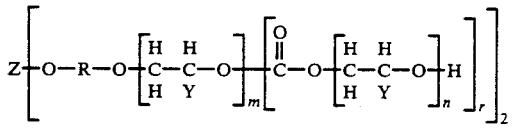

wherein Y is H or methyl, wherein m and n are positive numbers having a value of 1 to about 5, wherein R is a polyoxyethylene or a polyoxypropylene group having an average molecular weight between about 62 and 600, wherein r is a positive integer having a value of 1 to 5, wherein Z is a difunctional group formed by the reaction of an acid anhydride with a polyoxyethylene glycol or a polyoxypropylene glycol, and wherein the acid anhydride is an anhydride of an organic acid selected from the group consisting of maleic anhydride, succinic anhydride and phthalic anhydride.

2. A method as in claim 1 wherein about 2 to about 6 wt. %, based on the foundry sand, of an aqueous solution containing from about 40 to about 60 wt. % of said sodium silicate is added to the foundry sand.

3. A method as in claim 2 wherein from about 5 to about 15 wt. %, based on the weight of said aqueous solution of sodium silicate, of said carbonate hardener is added to the foundry sand.

4. A method as in claim 3 wherein said carbonate hardener has a hydroxyl number within the range of about 175 to about 350.

5. A method as in claim 4 wherein Y represents H, R represents a polyoxyethylene group and Z represents a difunctional group formed by the reaction of an acid anhydride with a polyoxyethylene glycol.

6. A method as in claim 4 wherein Y represents methyl, R represents a polyoxypropylene group and Z represents a difunctional group formed by the reaction of an acid anhydride with a polyoxypropylene glycol.

7. A method for the preparation of a foundry sand composition that is self-hardening after a working life of about 10 to about 20 minutes which comprises the steps of:

a) mixing a foundry sand with about 2 to about 6 wt. %, based on said foundry sand, of an aqueous solution containing from about 40 to about 60 wt. % of sodium silicate, the ratio of $SiO_2/Na_2O$ of said sodium silicate being within the range of about 2.2 to 3, to form an initial sand mixture, and b) adding to said initial sand mixture from about 5 to about 15 wt. %, based on the weight of the aqueous solution of sodium silicate, of a carbonate hardener to thereby provide said foundry sand composition, c) said carbonate hardener having the formula:

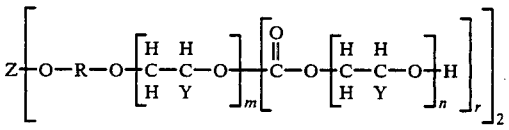

wherein Y is H or methyl, wherein m and n are positive numbers having a value of 1 to about 5, wherein R is a polyoxyethylene or a polyoxypropylene group having an average molecular weight between about 62 and 600, wherein r is a positive integer having a value of 1 to 5, wherein Z is a difunctional group formed by the reaction of an acid anhydride with a polyoxyethylene glycol or a polyoxypropylene glycol, and wherein the acid anhydride is an anhydride of an organic acid selected from the group consisting of maleic anhydride, succinic anhydride and phthalic anhydride.

8. A method as in claim 7 wherein the carbonate hardener has a hydroxy number within the range of about 175 to about 350.

9. A method as in claim 8 wherein Y represents H, R represents a polyoxyethylene group and Z represents a difunctional group formed by the reaction of an acid anhydride with a polyoxyethylene glycol.

10. A method as in claim 9 wherein the acid anhydride is maleic anhydride.

11. A method as in claim 9 wherein the acid anhydride is phthalic anhydride.

12. A method as in claim 8 wherein Y represents methyl, R represents a polyoxypropylene group and Z represents a difunctional group formed by the reaction of an acid anhydride with a polyoxypropylene glycol.

13. A method as in claim 12 wherein the acid anhydride is maleic anhydride.

14. A method as in claim 12 wherein the acid anhydride is phthalic anhydride.

15. A foundry sand composition that is self-hardening after a working life of about 10 to about 20 minutes consisting essentially of a foundry sand, a sodium silicate binder and a carbonate hardener, said foundry sand composition having been prepared by a process which comprises the steps of:

a) mixing a foundry sand with about 2 to about 6 wt. %, based on said foundry sand, of an aqueous solution containing from about 40 to about 60 wt. % of sodium silicate, the ratio of $SiO_2/Na_2O$ of said sodium silicate being within the range of about 2.2 to 3, to form an initial sand mixture, and b) adding to said initial sand mixture from about 5 to about 15 wt. %, based on the weight of the aqueous solution of sodium silicate, of a carbonate hardener to thereby provide said foundry sand composition, c) said carbonate hardener having the formula:

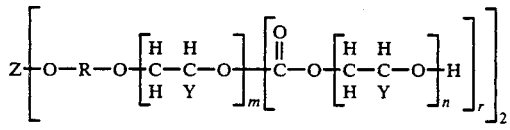

wherein Y is H or methyl, wherein m and n are positive numbers having a value of 1 to about 5, wherein R is a polyoxyethylene or a polyoxypropylene group having an average molecular weight between about 62 and 600, wherein r is a positive integer having a value of 1 to 5, wherein Z is a difunctional group formed by the reaction of an acid anhydride with a polyoxyethylene glycol or a polyoxypropylene glycol, and wherein the acid anhydride is an anhydride of an organic acid selected from the group consisting of maleic anhydride, succinic anhydride and phthalic anhydride.

16. A method as in claim 15 wherein said carbonate has a hydroxyl number within the range of about 175 to about 350.

17. A method as in claim 17 wherein Y represents H, R represents a polyoxyethylene group and Z represents a difunctional group formed by the reaction of an acid anhydride with a polyoxyethylene glycol.

18. A method as in claim 16 wherein Y represents methyl, R represents a polyoxypropylene group and Z represents a difunctional group formed by the reaction of an acid anhydride with a polyoxypropylene glycol.

* * * * *